US011391120B1

(12) United States Patent
Zhong et al.

(10) Patent No.: US 11,391,120 B1
(45) Date of Patent: Jul. 19, 2022

(54) ROBUSTNESS OF FLAPPER VALVE OPEN/CLOSE

(71) Applicant: Halliburton Energy Services, Inc., Houston, TX (US)

(72) Inventors: Xiaoguang Allan Zhong, Carrolton, TX (US); Shobeir Pirayeh Gar, Carrolton, TX (US); David Allen Dockweiler, Carrolton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/240,326

(22) Filed: Apr. 26, 2021

(51) Int. Cl.
*E21B 34/16* (2006.01)

(52) U.S. Cl.
CPC ..... *E21B 34/16* (2013.01); *E21B 2200/05* (2020.05)

(58) Field of Classification Search
CPC ..... E21B 34/16; E21B 2200/05
See application file for complete search history.

(56) References Cited

U.S. PATENT DOCUMENTS 2,735,498 A * 2/1956 Muse ..... E21B 34/063 166/317
4,196,745 A 4/1980 Schützer
4,531,587 A * 7/1985 Fineberg ..... F16K 1/2007 166/332.8
5,137,090 A * 8/1992 Hare ..... E21B 34/105 166/325
5,159,981 A * 11/1992 Le ..... E21B 34/06 166/325
5,310,005 A 5/1994 Dollison
6,227,299 B1 * 5/2001 Dennistoun ..... E21B 34/10 166/332.8
7,021,386 B2 * 4/2006 Vick, Jr ..... F16K 15/033 166/332.8
7,204,313 B2 4/2007 Williams et al.
(Continued)

FOREIGN PATENT DOCUMENTS

WO WO 2020/242464 A1 12/2020
WO WO-2020242464 A1 * 12/2020 ..... E21B 34/12
WO WO-2020242465 A1 * 12/2020 ..... E21B 34/12

OTHER PUBLICATIONS

D1 Halliburton, Completion Tools, Subsurface Safety Equipment 10, 42 pages.
(Continued)

*Primary Examiner* — Matthew R Buck
(74) *Attorney, Agent, or Firm* — Haynes and Boone, LLP

(57) ABSTRACT

A valve assembly employed in subterranean wellbore systems includes a flapper member biased to a closed position by a pair of opposed wire springs. The wire springs provide sufficient torque to ensure robust operation of the flapper member and permit sufficient fluid flow through the limited space available in the valve assembly. A pair of symmetrical pair of wire springs may be robustly manufactured and individually installed without unnecessary accumulation of manufacturing tolerances or errors, thereby providing predictable torque levels to the flapper member. The wire springs may be secured in blind holes or other features defined in a circumferential surface of the flapper member to ensure the springs remain engaged with the flapper member throughout the operation of the valve assembly.

20 Claims, 7 Drawing Sheets

(56) References Cited

U.S. PATENT DOCUMENTS

| | | | | |
|---|---|---|---|---|
| 7,600,534 | B2 * | 10/2009 | Deaton | E21B 34/06 137/527 |
| 7,798,235 | B2 * | 9/2010 | Mondelli | E21B 34/10 166/373 |
| 8,191,570 | B2 * | 6/2012 | Purkis | E21B 34/12 137/493.9 |
| 8,342,247 | B2 * | 1/2013 | Vick, Jr | F16K 15/033 166/332.8 |
| 10,240,431 | B2 * | 3/2019 | Caminari | E21B 34/10 |
| 2009/0151924 | A1 * | 6/2009 | Lake | F16K 31/003 166/53 |
| 2014/0124212 | A1 | 5/2014 | Slup | |

OTHER PUBLICATIONS

Search Report and Written Opinion issued for International Patent Application No. PCT/US2021/029247, dated Jan. 20, 2022, 10 pages, ISR/KR.

* cited by examiner

ROBUSTNESS OF FLAPPER VALVE OPEN/CLOSE

BACKGROUND

The present disclosure relates generally to equipment and operations performed in conjunction with subterranean wellbores. Example embodiments described herein include flapper valve assemblies that are biased to a closed configuration.

Subsurface safety valves are often employed to control fluid flow in a production string or other downhole tubing strings. For example, a subsurface safety valve may be maintained in an open configuration during nominal operations and may be moved to a closed configuration to block the upward flow of formation fluids through the production string should a failure occur, or hazardous condition exist at the surface. A flapper member, or a "flapper," may be provided that can be pivoted to configure the valve in the open and closed configurations. Hydraulic pressure may be applied to pivot the flapper member to an open position, and when the hydraulic pressure is removed, either manually or automatically in response to a hazardous condition, a biasing member may operate to pivot the flapper member to a closed position.

Torsion springs and coiled extension springs are often provided as the biasing member that urges the flapper member to the closed position. These types of springs may have limited torque capacity due to the limited space available in a subsurface valve assembly. With limited torque capacity, these springs may fall to move the flapper member fully to the closed position, which could potentially permit hazardous fluids to escape into the surrounding environment through the partially closed production string.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes valve assemblies that may be employed in subterranean wellbore systems. In particular, flapper valve assemblies are described that employ wire springs on opposite lateral sides of a flapper member that cooperatively bias the flapper member to a closed position. The wire springs provide sufficient torque to ensure robust operation of the flapper member and permit sufficient fluid flow through the limited available space through the valve assembly. A symmetrical pair of wire springs may be robustly manufactured and individually installed without unnecessary accumulation of manufacturing tolerances or errors to provide predictable torque to the flapper member. The wire springs may be secured in blind holes or other features defined in the flapper member to ensure the springs remain engaged with the flapper member throughout the operation of the valve assembly.

Figure 1:
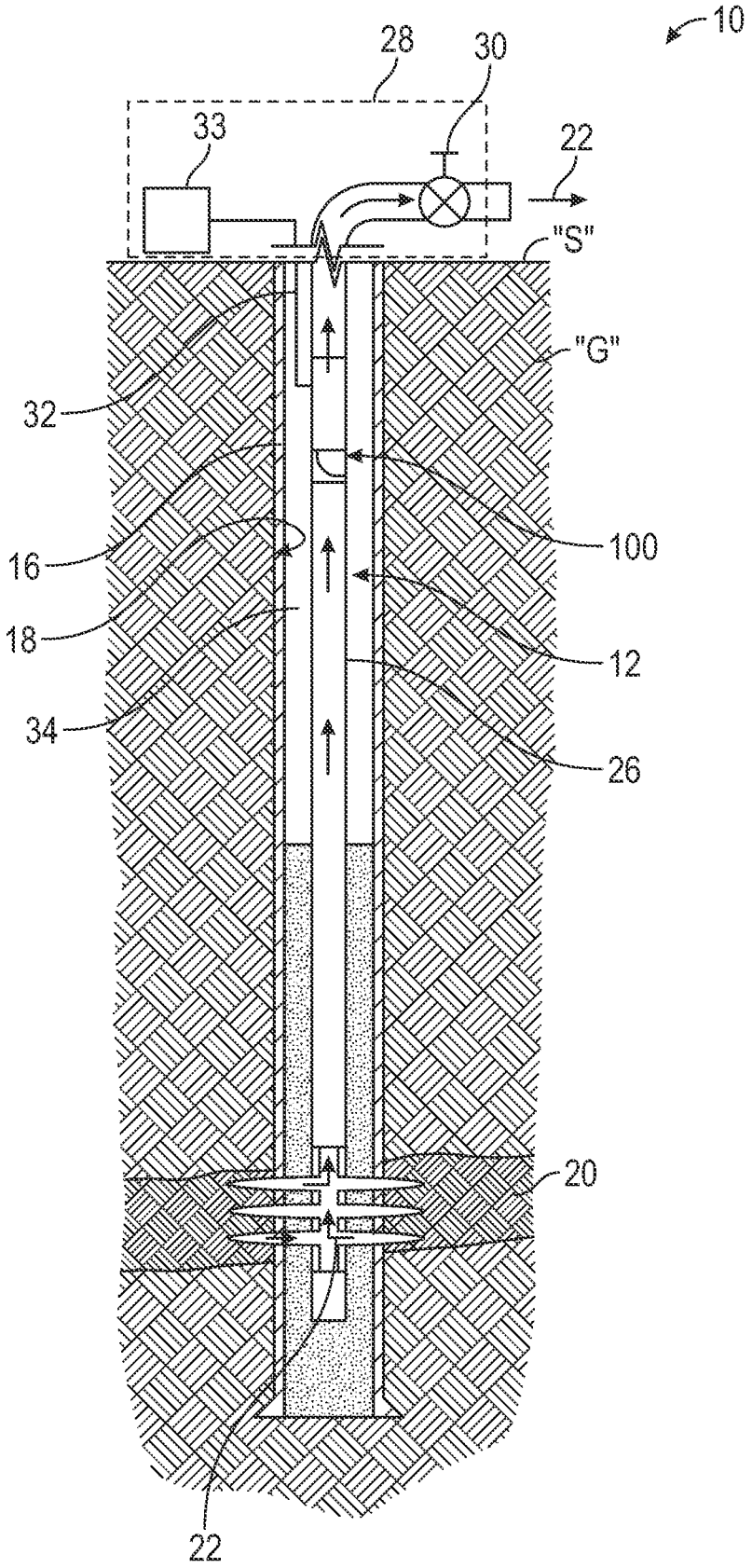
FIG. 1 is a partial, cross-sectional side view of a wellbore system including a valve assembly in accordance with aspects of the present disclosure.

FIG. 1 illustrates a wellbore system 10 in accordance with example embodiments of the present disclosure. In wellbore system 10, a wellbore 12 extends from a surface location "S" through a geologic formation "G" In some embodiments, the surface location "S" may be a terrestrial location as illustrated, and in other embodiments, the surface location "S" may be an offshore seabed without departing from the scope of the disclosure. A casing string 16 may be cemented in the wellbore 12 to provide structural support and prevent collapse of wellbore walls 18. Aspects of the disclosure may also be practiced in n-cased or open hole portions of the wellbore 12. The wellbore 12 intersects a hydrocarbon producing formation 20 from which fluids 22 may be produced. A production string 26 extends between the hydrocarbon producing formation 20 and the surface location "S" and provides a conduit for communicating the fluids 22 to the surface location "S." A wellhead 28 at the surface location "S" includes one or more valves 30 for controlling the flow and distribution of fluids 22 received from the wellbore 12.

The wellbore system 10 further includes a valve assembly 100 disposed at a subterranean location within the wellbore 12. The valve assembly 100 is interconnected in the production string 26 and may alternatively be coupled within other types of wellbore tubing strings in other embodiments (not shown). The valve assembly 100 may be operated between an open configuration in which the flow of fluids 22 though the production string 26 is permitted and a closed configuration in which the flow of fluids in inhibited. A control line 32 extends from the valve assembly 100 to a controller 33 in the wellhead 28 or another remote location where communication with the valve assembly 100 maybe required. As illustrated, the control line 32 extends within an annulus 34 defined radially between the production string 26 and the casings string 16. In other embodiments, the control line 32 could alternatively be arranged internal to the production string 26, or otherwise formed in a sidewall of the production string 26.

The control line 32 may facilitate maintaining the valve assembly 100 in the open configuration in nominal operations and closing the valve assembly 100 in the event of an emergency or hazardous condition at the surface location "S." For example, the control line 32 may include a hydraulic conduit that provides hydraulic pressure to the valve assembly 100 to maintain the valve assembly 100 in the open configuration. Reduction or elimination of the hydraulic pressure may operate to close the valve assembly 100 in response to instructions from an operator, or automatically in response to a predetermined wellbore condition.

Figure 2A:
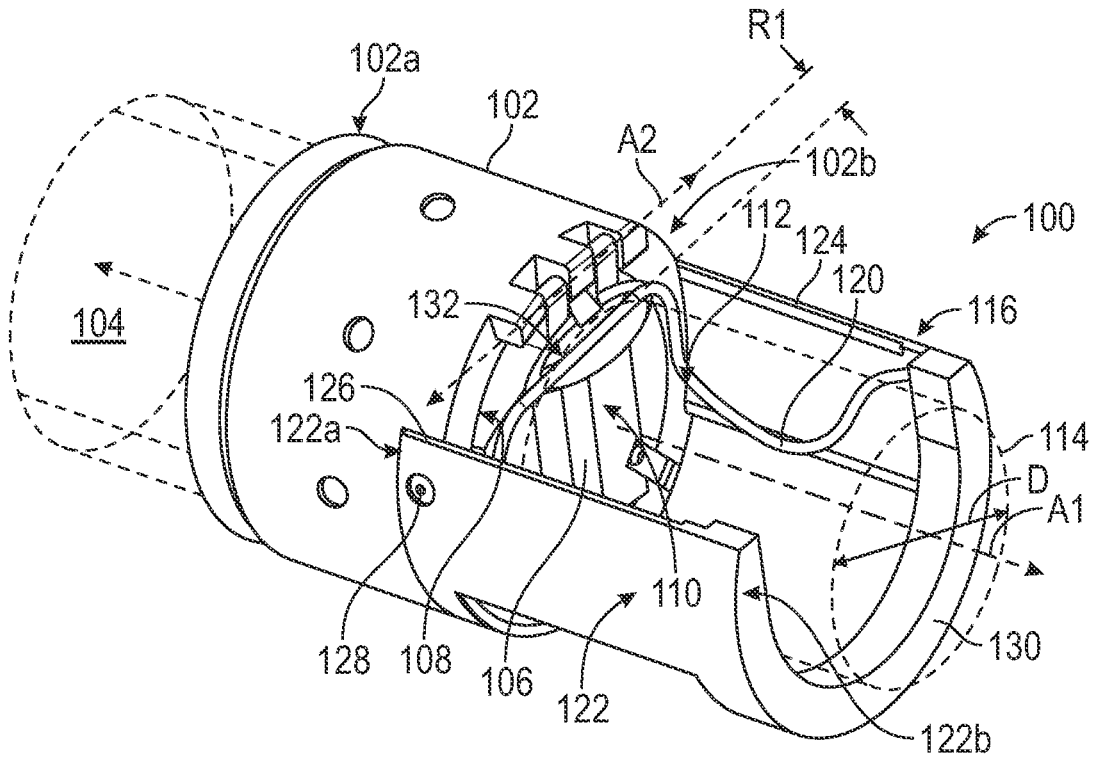
FIG. 2A is a perspective view of a valve assembly, which may be employed in the wellbore system of FIG. 1, illustrating a flapper member biased to a closed position with a wire spring extending across a saddle defined in the flapper member.

Referring to FIG. 2A, the valve assembly 100 includes a generally tubular body 102 extending along a longitudinal axis A1. The tubular body 102 defines a first end 102*a* and a second end 102*b* and may be interconnected in the production string 26 (FIG. 1) such that the first end 102*a* is disposed uphole of the second end 102*b*. A flow path 104 is defined along the longitudinal axis A1 through the production string 26 and the tubular body 102. A flapper member 106 is pivotably coupled to the second end 102*b* of the tubular body 102 about a pivot axis A2. The flapper member 106 is movable between open and closed positions in the valve assembly 100. Specifically, the flapper member 106 is movable between the closed position illustrated in which the flapper member 106 engages a valve seat 108 obstructing the flow path 104 and an open position (see FIG. 9B) in which the flapper member 106 pivots away from the valve seat 108, such that flow through the valve seat 108 is permitted. In some embodiments, the open position of the flapper member 106 is generally orthogonal to the closed position of the flapper member 106 (see FIG. 9B). For example, an axial face 110 of the flapper member 106 may be oriented in oriented in a lateral direction when the flapper member is rotated to the open position about pivot axis A2.

The flow path 104 extends through a fixed opening 112 defined through the valve seat 108. As illustrated, the fixed opening 112 is generally circular and centered about the longitudinal axis A1. Other geometries for the fixed opening 112 are contemplated within the scope of the disclosure. The flow path 104 extends from the fixed opening 110 along a cylinder 114 defined around the axis A1 and having a diameter D similar to the diameter D of the fixed opening 112. Generally, the valve assembly 100 is arranged so that the flow path 104 along the cylinder 114 is unobstructed when the flapper member 106 is in the open position so as not to impede fluid flow therethrough.

The valve assembly 100 includes a closure mechanism 116 that imparts a biasing force to the flapper member 106, thereby urging the flapper member 106 toward the valve seat 108.

The closure mechanism 116 includes a wire spring 120 and a spring support 122 fixedly coupled to the tubular body 102. The spring support 122 includes a pair of lateral arms 124, 126 extending axially from the tubular body 102. A first end 122*a* of the spring support 122 is coupled to the tubular body 102 by fasteners 128, which may include screws, pins, threads and the like. A second end 122*b* of the spring support 122 includes a circumferential cross-beam 130 coupling the lateral arms 124, 126 to one another. The cross-beam 130 provides rigidity to the spring support 122 and extends circumferentially around the cylinder 114 such that the flow path 104 is not obstructed by the cross-beam 130.

The wire spring 120 is axially constrained between the spring support 122 and a saddle 132 defined in the axial face 110 the flapper member 106. The saddle 132 is a curved groove extending laterally across the axial face 110 at a radial distance R1 from the pivot axis A2. A first end 120*a* of the wire spring 120 engages the saddle 132 to impart a torque to the flapper member 106 about the pivot axis A2. The curved shape of the saddle 132 allows the saddle 132 to maintain engagement with the wire spring 120 as the flapper member 106 pivots about the axis A2. At a second end 120*b* of the wire spring 120, the lateral arms 124, 126 of the spring support 122 provide a base against which the wire spring 120 may extend to impart a force to the flapper member 106 to close the valve assembly 100. Generally, greater radial distances R1 from the pivot axis A2 permit the closure mechanism 116 to provide greater torque to flapper member 102. However, greater radial distances R1 may also require more complex closure mechanisms and/or closure mechanisms that occupy more of the limited space in a downhole valve assembly.

Figure 2B:
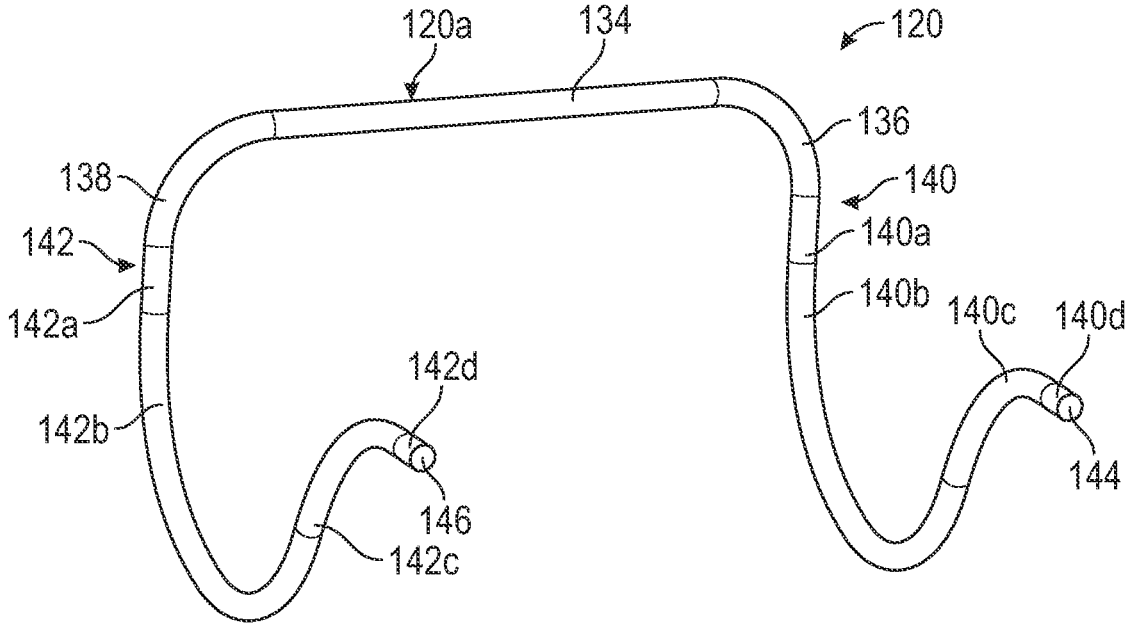
FIG. 2B is a perspective view of the wire spring of FIG. 2A.

As illustrated in FIG. 2B, the wire spring 120 is generally constructed from a single wire strand with a generally circular cross section. Wire spring 120 may be constructed as a wireform spring devoid of any coils or cylindrical structures that could intrude into the flow path 104. The d int springs discussed herein A straight wire segment 134 extends laterally across the wire spring 120 at a first end 120*a* of the wire spring 120. The straight wire segment 134 rolls within the saddle 132 (FIG. 2A) as the flapper member 106 pivots between the open and closed positions. Extending from the straight wire segment 134 are generally symmetrical shoulder curves 136, 138 and lateral arms 140, 142. The lateral arms 140, 142 are constructed of straight sections 140*a*, 142*a*, major curves 140*b*, 142*b*, minor curves 140*c*, 142*c* and straight sections 140*d*, 142*d* terminating in respective free ends 144, 146 at a second end 120*b* of the wire spring 120. The major curves 140*b*, 142*b* and minor curves 140*c*, 142*c* of the lateral arms 140, 142 provide flexibility to the wire spring 120, and specifically permit the wire spring 120 to be compressed axially (by approximating the free ends 144, 146 with the straight wire segment 134). Thus, when the free ends 144, 146 are axially restrained by the spring support 122 (FIG. 2A), the wire spring 120 may impart an axial force to the flapper member 106 (FIG. 2A). In some embodiments, the free ends 144, 146 may have end caps (not shown) or other features installed thereon to facilitate securing the free ends 1446 to the spring support 122.

The wire spring 120 exhibits a relatively complex geometry in order to provide a sufficient axial force to reliably close the valve member 100 while not intruding into the flow path 104. For example, the lateral arms 140, 142 of the wire spring 120 are not coiled, but are generally defined in a single plane such that the lateral arms 140, 142 do not interfere with the pivotal movement of the flapper member 106 or the flow of fluids through the flow path 104. Wireform springs such as wire spring 120 are generally constructed with automated presses and hand bending equipment. Wire-form springs are bent to include concavities and other features in their geometry that permit the spring to store energy. This complex geometry may sometimes result in manufacturing difficulties and stacking of tolerances that may cause the wire spring 120 to behave in unexpected ways. For example, if the lateral arms 140, 142 are not exactly symmetrical the wire spring 120 may tend to twist. If each of the sections, e.g., 134, 136, 138, 140, 142, of the wire spring 120 are constructed within a predefined tolerance defined for the particular section, but the cumulative effect of the manufacturing errors result in an accumulation of errors across the entire wire spring 120, the wire spring may be have erratically, including becoming disengaged from the saddle 132 of the flapper member 106.

Figure 3:
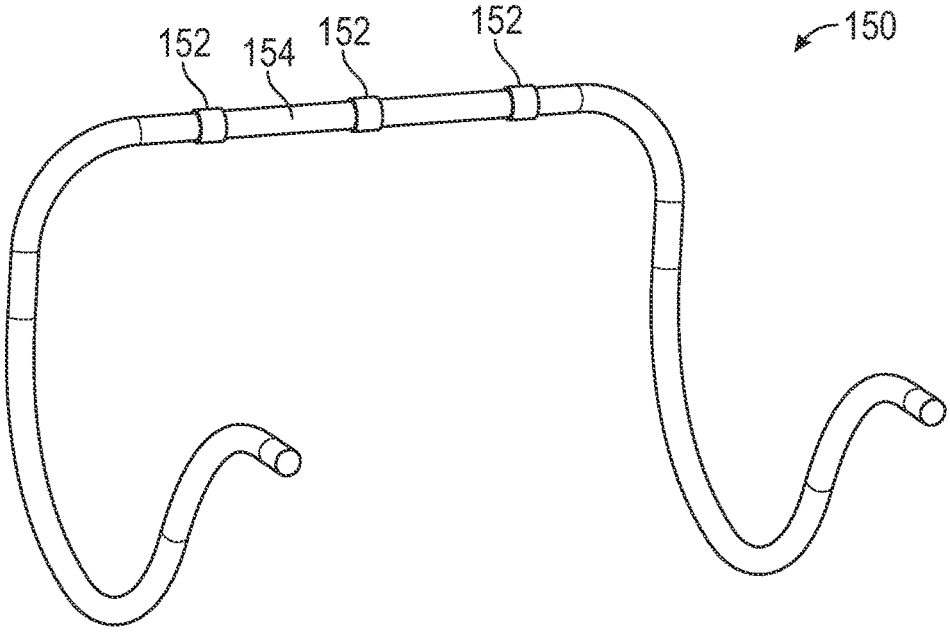
FIG. 3 is a perspective view of an alternate embodiment of a wire spring including resistance bands thereon, which may be employed in the valve assembly of FIG. 2A engaged with the saddle of the flapper member in accordance with aspects of the present disclosure.

Referring to FIG. 3, an alternate embodiment of a wire spring 150 includes resistance bands 152 supported on a straight wire segment 154 thereof. The wire spring 150 may be constructed as a wire-form spring in the same general shape as the wire spring 120 (FIG. 2B) described above. The resistance bands 152 may be constructed of rubber bands, molded elastomers or other suitable materials for increasing a frictional resistance between the straight wire segment 154 and the saddle 132 of a flapper member 106 (FIG. 2A). As illustrated, three laterally spaced resistance bands 152 are provided, and in other embodiments, any number of resistance bands 152 is contemplated. The resistance bands 152 may help to maintain the straight wire segment 154 engaged in the saddle 132, particularly when the flapper member 106 is an open position within the valve assembly 100. The high lateral forces provided by the wire spring 150 might otherwise cause the straight wire segment 154 to slip out of the saddle 132 when the flapper member 106 is rotated to the open position where the axial face 110 of the flapper member 106 is oriented in a lateral direction.

Figure 4:
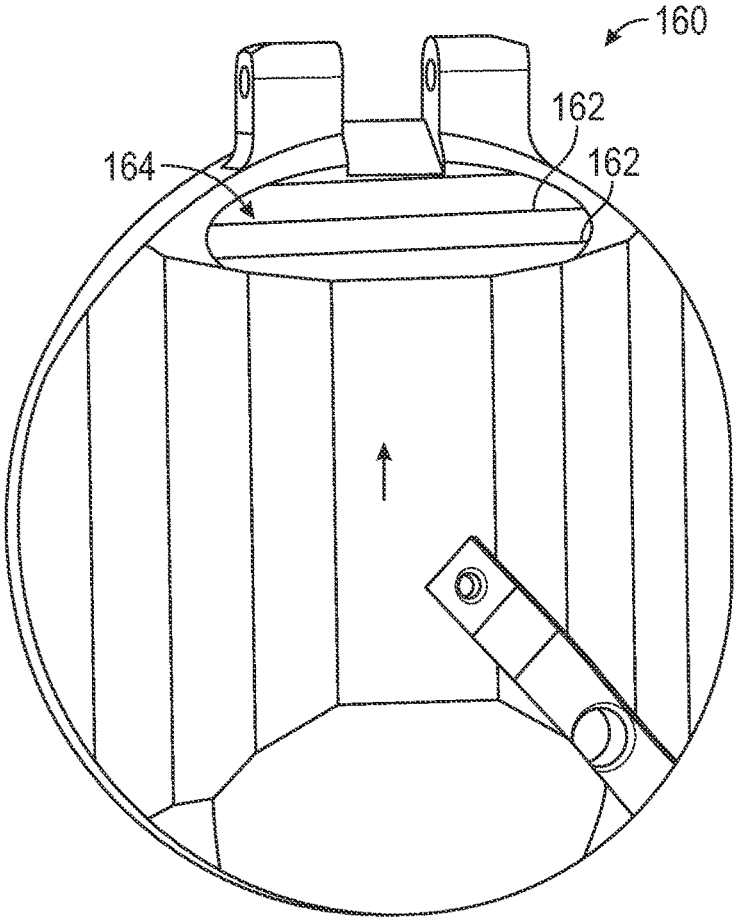
FIG. 4 is a perspective view of an alternate embodiment of a flapper member including a plurality saddle grooves defined therein, which may be employed in the valve assembly of FIG. 2A in engagement with a wire spring in accordance with aspects of the present disclosure.

FIG. 4 illustrates an alternate embodiment of a flapper member 160 including a plurality saddle grooves 162 defined in a saddle 164 thereof. The saddle grooves 162 extend laterally across the saddle 164 and increase frictional resistance between the saddle 164 and a straight wire segment 134 (FIG. 2B), 154 (FIG. 3) of a wire spring 120, 150. The flapper member 160 may be installed in place of the flapper member 106 in the valve assembly 100 and may be employed with either of the wire springs 120, 150.

Figure 5A:
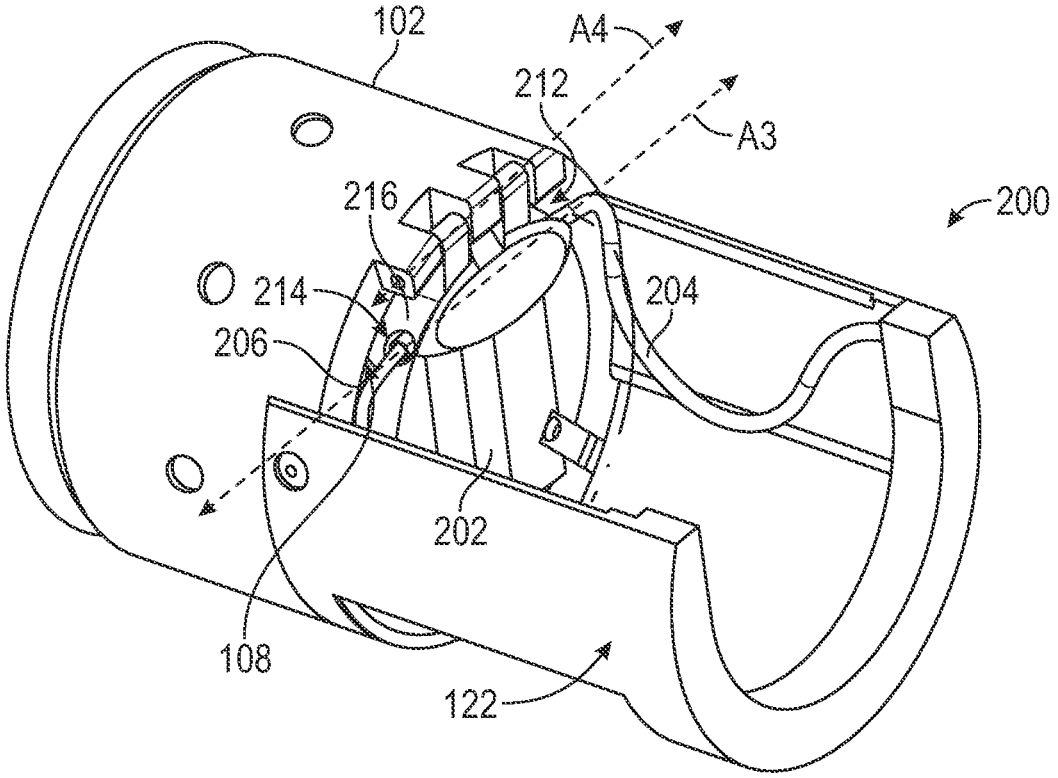
FIG. 5A is a perspective view of a valve assembly in accordance with aspects of the present disclosure, which may be employed in the wellbore system of FIG. 1, illustrating a flapper member biased to a closed position with a pair of opposed wire springs engaged in a pair of blind holes defined in the flapper member.

Referring to FIG. 5A, an alternate embodiment of a valve assembly 200 is illustrated that may be employed in the wellbore system 10 of FIG. 1. The valve assembly 200 includes a flapper member 202 biased to a closed position with a pair of opposed wire springs 204, 206. The flapper member 202 includes a pair of opposed blind holes 212, 214 defined in an outer circumferential surface 216 thereof, and each of the blind holes 212, 214 receives a free end 204*a*, 206*a* (FIG. 5B) of one of the opposed wire springs 204, 206. The blind holes 212, 214 restrain the free ends 204*a*, 206*a* in both axial and radial directions, and are sized to provide rotational freedom of the free ends 204*a*, 206*a* with respect to the flapper member 202 about an axis A3. The axis A3 defined by the blind holes 212, 214 is generally parallel to the pivot axis A4. In some embodiments, a resistance band (see FIG. 3), end cap or a non-metallic washer may be secured to the wire springs 204, 206 adjacent the respective free ends 204*a*, 206*a* to provide a secure fit within the blind holes 212, 214. The resistance bands, end caps or non-metallic washers may discourage the wire springs 204, 206 from disengaging the flapper member 202 in operation.

The axis A3 extends through the blind holes 212, 214 and is radially spaced from the pivot axis A4 about which the flapper member 202 pivots. The valve assembly 200 may employ the same generally tubular body 102 and spring support 122 as described above for use with valve assembly 100 (FIG. 2A). The flapper member 202 is movable between the closed position illustrated in which the flapper member 202 engages the valve seat 108 and an open position in which the flapper member 202 pivots away from the valve seat 108. The pair of opposed wire springs 204, 206 may be constructed as wire-form springs devoid of any coils or cylindrical structures. The wire springs 204, 206 may exhibit mirror symmetry, which permit the wire springs 204, 206 to cooperate to impart a biasing force to the flapper member 202, thereby urging the flapper member 202 toward the valve seat 108 and the closed position.

Figure 5B:
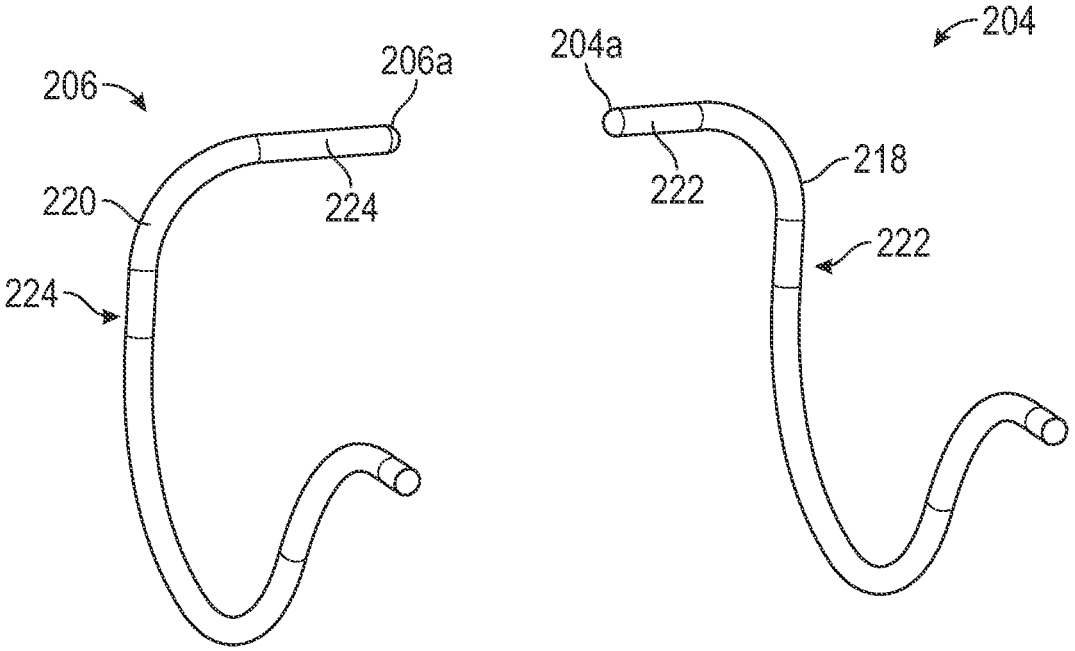
FIG. 5B is a perspective view of the pair of wire springs of FIG. 5A in accordance with aspects of the present disclosure.

As illustrated in FIG. 5B, the opposed wire springs 204, 206 each include a straight wire segment 222, 224 terminating in a respective free end 204*a*, 206*a*. The free ends 204*a*, 206*a* may roll within the blind holes 212, 214 as the flapper member 202 pivots between the open and closed positions. The opposed wire springs 204, 206 may include shoulder curves 218, 220 and lateral arms 222, 224 that are identical to the 136, 138 and lateral arms 140, 142 the wire spring 120 (FIG. 2B) described above. The pair of opposed wire springs 204, 206, however, are not as susceptible to the manufacturing and operational difficulties of the wire spring 120 described above.

The opposed wire springs 204, 206 exhibit a simpler geometry than the wire spring 120, and thus, lower tolerances and higher manufacturing precision may be achieved. Any manufacturing errors will not be accumulated to the same degree, and thus the structural behavior of the pair of opposed wire springs 204, 206 may be more predictable and the design may be more readily analyzed, adjusted and scaled for different valve sizes and loading conditions. A higher level of torque may thus be provided to the flapper member 202 to maintain the valve assembly 200 in a closed configuration. Additionally, since the free ends 204*a*, 206*a* may be secured in both axial and radial directions in the blind holes 212, 214, the wire springs 204, 206 may not be as susceptible to disengaging the flapper member 202 in operation.

Figure 6:
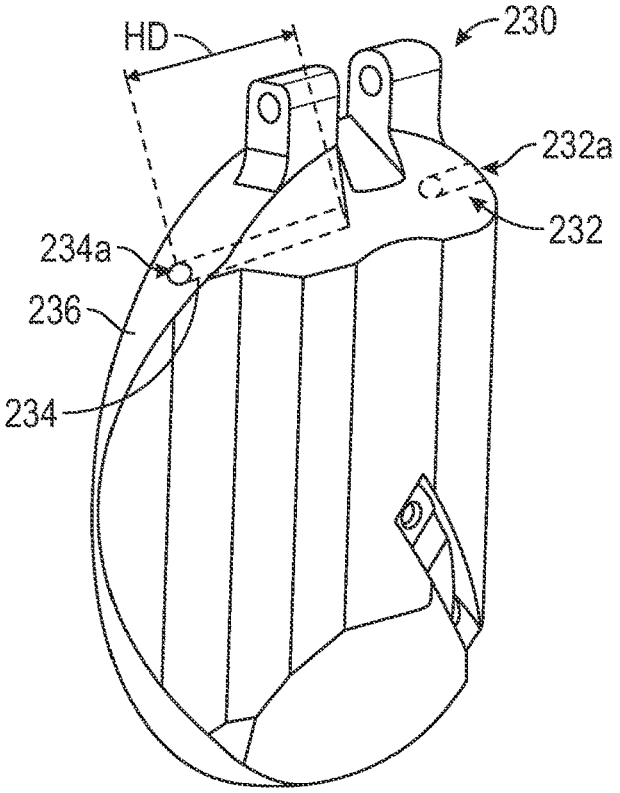
FIG. 6 is a perspective view of an alternate embodiment of a flapper member that may be employed in the valve assembly of FIG. 5A, illustrating a pair of blind holes for receiving ends of wire springs in accordance with aspects of the present disclosure.

Referring now to FIG. 6, a flapper member 230 is illustrated, which may be employed in place of flapper member 202 in valve assembly 200 (FIG. 5A). The flapper member 230 is devoid of a saddle, which may simplify machining operations in the construction of a valve assembly. Blind holes 232, 234 extend from lateral openings 232*a*, 234*a* in an outer circumferential surface 236 of the flapper member 230 to a hole depth HD. In some embodiments, the hole depth HD is selected such that the free ends 204*a*, 206*a* of wire springs 204, 206 (FIG. 5B) may abut a bottom surface of the blind holes 232, 234. In this manner, a predetermined lateral position of the wire springs 204, 206 may be maintained. In other embodiments, the hole depth HD may be selected such that the free ends that the free ends 204*a*, 206*a* do not reach the bottom surface of the blind holes 232, 234.

Figure 7A:
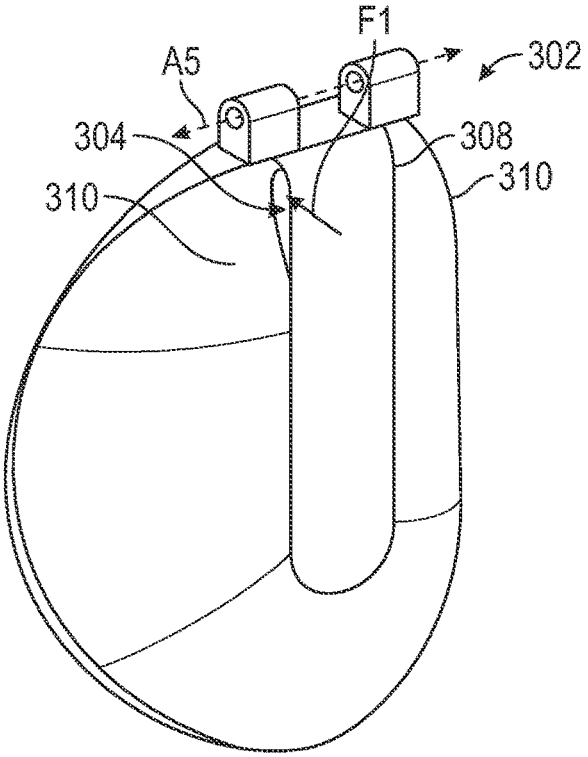
FIGS. 7A and 7B are perspective and side views of an alternate embodiment of a flapper member including a channel defined therein for receiving free ends of wire springs in accordance with aspects of the present disclosure.
Figure 7B:
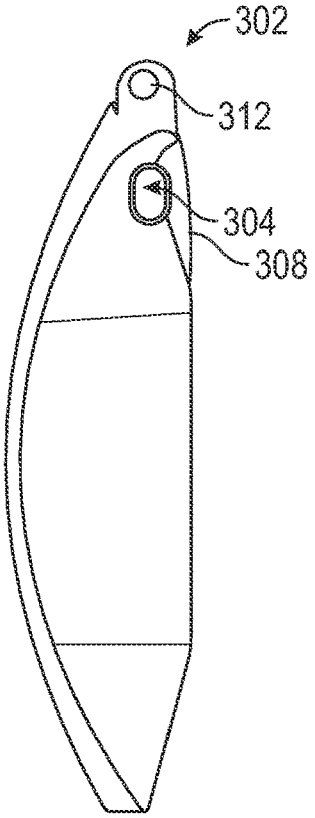
Figure 8A:
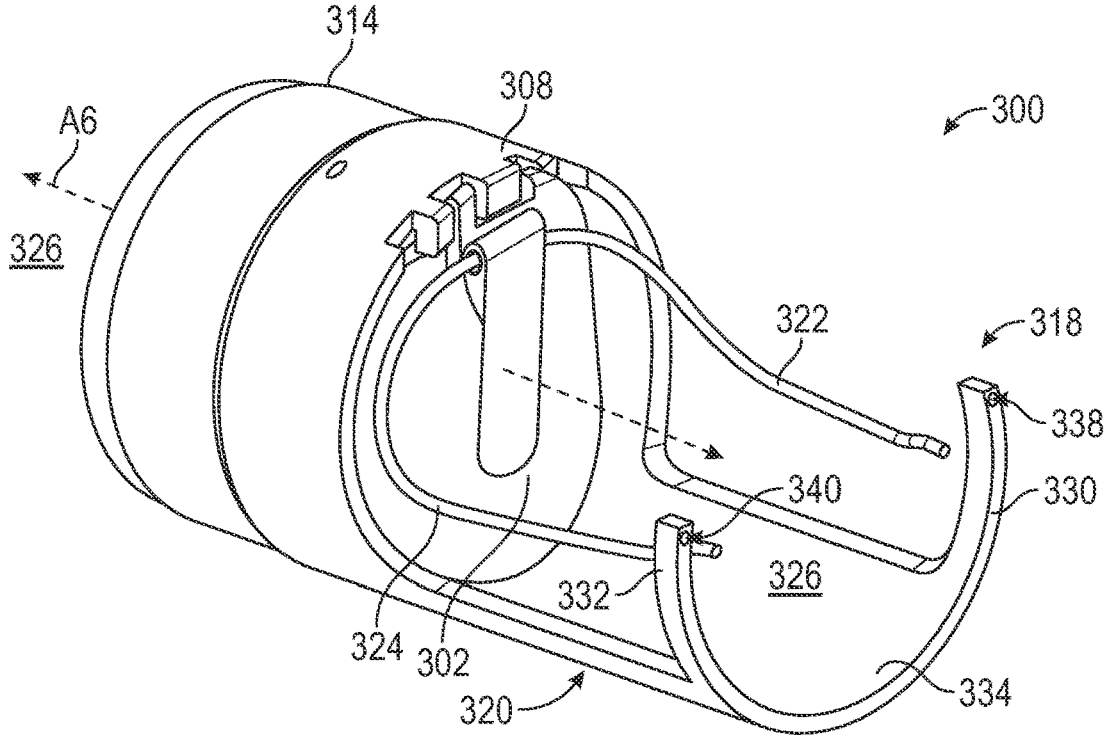
FIGS. 8A and 8B are perspective and end views of an alternate embodiment of a valve assembly in accordance with aspects of the present disclosure, the valve assembly employing the flapper member of FIGS. 7A and 7B with wire springs engaged in the channel defined in the flapper member.

Referring to FIGS. 7A and 7B, an alternate embodiment of a flapper member 302 is illustrated for use in a valve assembly 300 (FIG. 8A). The flapper member 302 includes a channel 304 defined therein for receiving free ends of wire springs 306 (FIG. 8A). The channel 304 extends through a central rib 308 of the flapper member 302 that protrudes beyond shoulders 310 on either lateral sides of the central rib. 308. The channel 304 is generally parallel and radially offset from a pair of pivot holes 312 defining a pivot axis A5 of the flapper member 302. An axial force F1 applied through the channel 304 may cause the flapper member 302 to pivot about the pivot axis A5. The channel 304 is elongated in a radial direction, which may facilitate pivoting of the flapper member 302 with the wire springs 306 engaged.

Figure 8B:
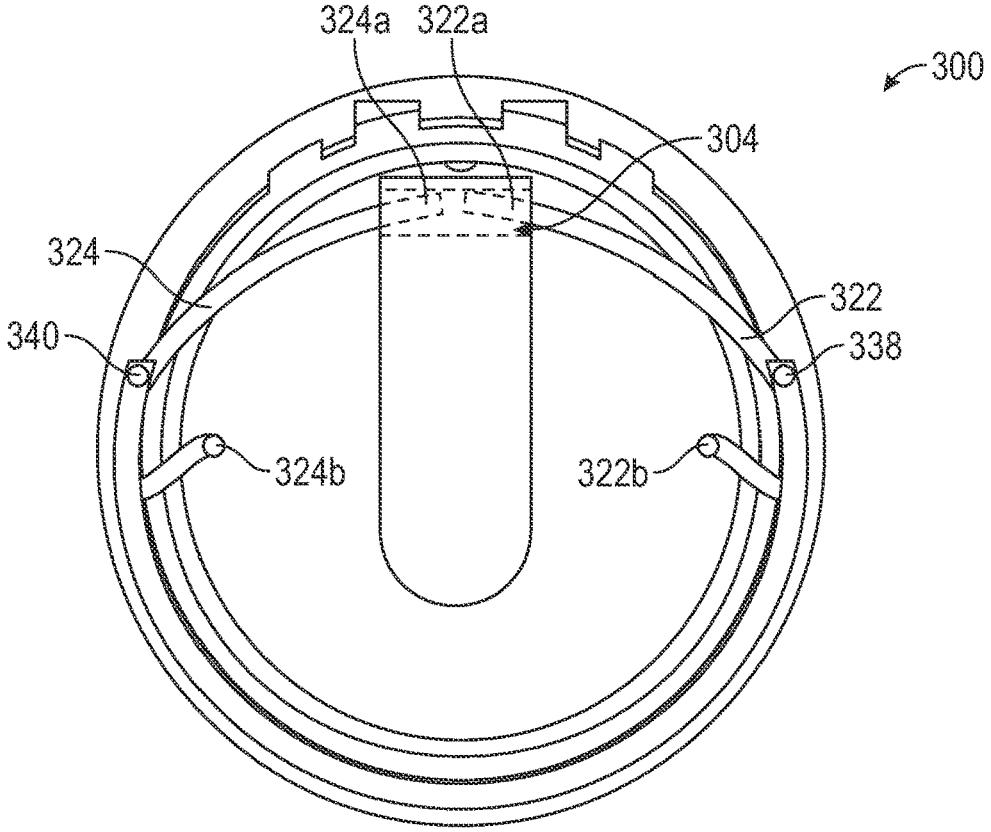

Referring to FIGS. 8A and 8B, valve assembly 300 includes a generally tubular body 314, which may be interconnected in the production string 26 (FIG. 1), the flapper member 302, and a closure mechanism 318. The closure mechanism 318 includes a spring support 320 fixedly coupled to the tubular body 314 and a pair of wire springs 322, 324 which may be decoupled from one another. A flow path 326 is defined along a longitudinal axis A6 through the tubular body 314, which is closed with the flapper member 302 in the closed position illustrated. The flapper member 302 is pivotably coupled to the spring support 320 such that the flapper member 302 may pivot to an open configuration wherein the flow path 326 is unobstructed.

The closure mechanism 318 imparts a biasing force to the flapper member 302, thereby urging the flapper member 302 to the closed position illustrated. The pair of wire springs 322, 324 are engaged with the flapper member 302 such that free ends 322*a*, 324*a* are disposed within the channel 304 and are axially constrained by the central rib 308. The free ends 322*a*, 324*a* are rotationally free with respect to the flapper member 302 and slidable along the elongated channel 304 as the flapper member 302 pivots. The wire springs 322, 324 are illustrated in relaxed configuration where free ends 322*b*, 324*b* are disengaged from the spring support 320. In the relaxed configuration, when the free ends 322*a*. 324*a* at a first end of the wire springs 322, 324 are received in the channel 304, the free ends 322*b*, 324*b* at a second end of the wire springs are displaced axially and laterally with respect to axial holes 338, 340 defined in the spring support 320. In an operational configuration, the free ends 322*b*, 324*b* may be installed in the axial holes 338, 340 to preload the wire springs 322, 324 between the spring support 320 and the flapper member 302 such that the wire springs 322, 324 urge the flapper member to the closed configuration.

The spring support 320 extends axially along the longitudinal axis A6 and includes a pair of lateral arms 330, 332 axially spaced from the flapper member 302. A circumferential cross beam 334 couples the lateral arms 330, 332 to one another. The circumferential cross beam 334 extends circumferentially around the flow path 326 between the lateral arms 330, 332 such that the flow path 326 is not obstructed. The lateral arms 330, 332 each include an axial hole 338, 340 defined therein for receiving a free end 322*b*, 324*b* of the wire springs 322, 324. The axial holes 338, 340 are positioned such that the wire springs 322, 324 may be axially compressed between the lateral arms 330, 332 and the flapper member 302 when the free ends 322*b*, 324*b* are received therein. The wire springs 322, 324 may also be shaped such that the wire springs 322, 324 are laterally compressed between the spring support 320 and the flapper member 302 when the free ends 322*b*, 324*b* are engaged in the axial holes 338, 340. The lateral compression of the springs 322, 324 may serve to maintain the free ends 322*a*, 324*a* within the channel 304.

The decoupled wire springs 322, 324 may be installed individually by first installing the free ends 322*a*, 324*a* within the channel 304 and subsequently installing the free ends 322*b*, 324*b* in the axial holes 328. The decoupled wire springs 322, 324 may be installed individually without permanently deforming the wire springs 322, 324. A combined spring (not shown) that would be formed if the free ends 322*a*. 324*a* were joined would not as readily be installed through the channel 304 without permanently deforming the spring and would not as reliably and predictably provide a closure force to the flapper member 302.

Figure 9A:
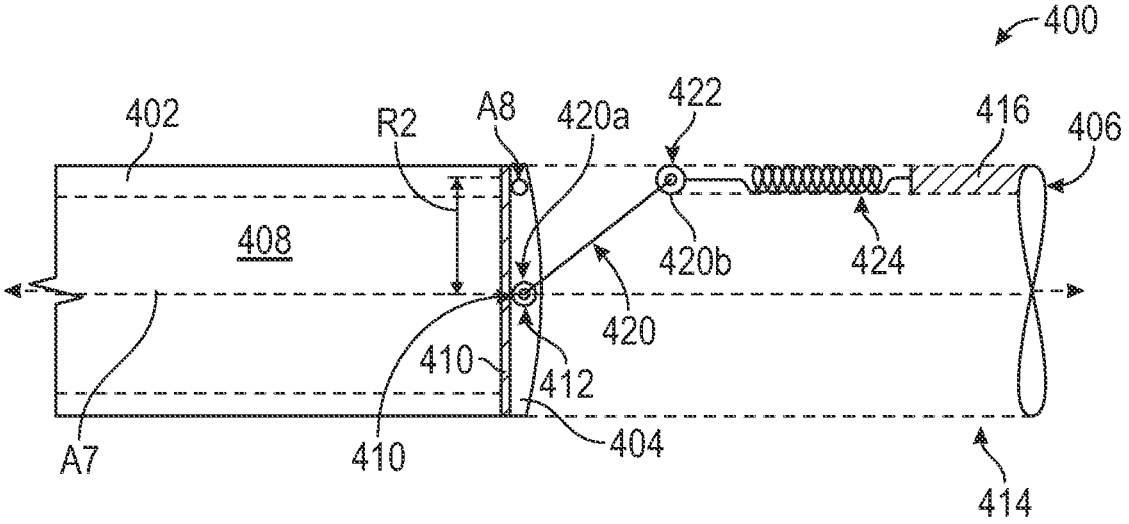
FIGS. 9A and 9B are cross-sectional side views of an alternate embodiment of a valve assembly in closed and open configurations respectively, illustrating a linear spring coupled in a closure mechanism with a linkage member in accordance with aspects of the present disclosure.
Figure 9B:
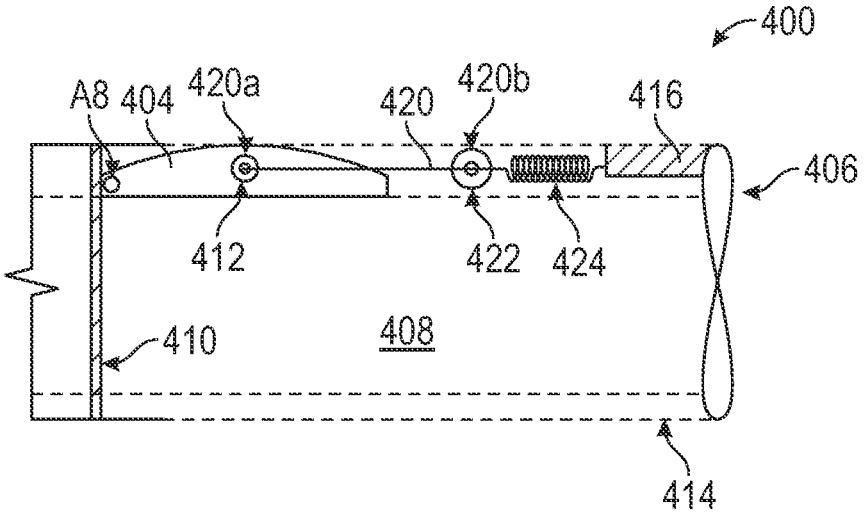

Referring now to FIGS. 9A and 9B, a valve assembly 400 is illustrated in closed (FIG. 9A) and open (FIG. 9B) configurations. The valve assembly 400 may be interconnected in the production string 26 (FIG. 1) and generally includes a tubular body 402, a flapper member 404 and a closure mechanism 406 that biases the flapper member 404 to the closed configuration.

The tubular body 402 defines a longitudinal axis A6 and a flow path 408 extending therethrough. The flapper member 404 pivots about a pivot axis A7 and engages a valve seat 410 in the closed configuration. One or more lateral openings 412 is defined the flapper member 404 for engaging the closure mechanism 406. The lateral openings 412 may be defined in an outer circumferential surface of the flapper member 404 (similar to the blind holes of flapper member 230, FIG. 6) or in a central rib of the flapper member 404 (similar to the channel 304 of flapper member 302, FIG. 7A). The lateral openings 412 may be defined at a radial distance R2 from the pivot axis A8. In some embodiments, the radial distance R2 may be large enough that the lateral openings 412 are defined generally in a center of the flapper member 404 or further from the pivot axis A8.

The closure mechanism 406 includes a spring support 414 extending axially from the tubular body 402. The spring support 414 may be fixedly coupled to the tubular body 402 and define a fixed reference support 416 thereon. The spring support 414 may include lateral arms and a circumferential cross-beam similar to the spring support 122 (FIG. 2A) or 320 (FIG. 8A). In some embodiments, the fixed reference support 416 may include a feature defined on one of the lateral arms similar to the axial holes 328 (FIG. 8A).

Coupled between the flapper member 404 and the fixed reference support 416, the closure mechanism 406 includes one or more link members 420, a hinge 422 and a biasing member 424. At a first end 420*a* of the one or more link members 420, the link members 420 are pivotally coupled to the flapper member 404 at the one or more lateral openings 412. In some embodiments, a pair of opposed lateral openings 412 may receive respective free ends of a pair of individual link members 420 such that the free ends may rotate within the lateral openings 412. In other embodiments, a link member may be threaded through a channel defined in the flapper member (see FIG. 7B). The link members 420 may be generally rigid or may be flexible in operation, and may include any of the wire springs 204, 206, 306, 322, 324 described herein. A second end 420*b* of the one or more link members 420 is coupled to the hinge 422. The hinge 422 may be constructed as disk with a central rotation ring therein. The hinge 422 pivotally couples the one or more link members 420 to the biasing member 424. The biasing member 424 is supported between the fixed reference support 416 and the hinge 422, and may include a linear coiled spring, a stack of spring washers or other axially compressible structure.

As illustrated in FIG. 9A, when the valve assembly 400 is in the closed configuration, the biasing member 424 is axially expanded against the fixed reference support 416 to maintain the hinge 422 and the second end 420*b* of the one or more link members 420 at an axially remote location with respect to the fixed reference support 416. A force F2 provided by the biasing member 424 is transferred through the one or more link members 420 to the flapper member 404 to maintain the flapper member 404 engaged with a valve seat 426. When the valve assembly 400 is moved to an open configuration (FIG. 9B), for example with a hydraulically actuated flow tube (not shown), the biasing member 424 is axially compressed against the fixed reference support 416. The hinge 422 and the second end 420*b* of the one or more link members 420 are moved to an axially approximate location with respect to the fixed reference support 416 permitting the flapper member 404 to pivot to a position that is generally orthogonal to the position of the flapper member 404 in the closed configuration. In this orthogonal position, the flapper member 404 does not intrude into the flow path 408 defined by the tubular body and extending into the spring support 414.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to a first aspect, the disclosure is direct to a downhole valve assembly. The assembly includes a tubular body defining a longitudinal axis and a flow path therethrough, a flapper member pivotally coupled to tubular body about a pivot axis and movable between a closed position where the flapper member prevents fluid flow through the flow path and an open position where fluid flow through the flow path is permitted, the flapper member including a pair of opposed lateral openings defined therein radially spaced from the pivot axis, a spring support coupled to the tubular body and extending axially along the longitudinal axis and a pair of opposed wire springs each individually coupled between the spring support and the flapper member, the wire springs each including a free end restrained in a respective one of the lateral openings defined in the flapper member.

In one or more embodiments, the pair of opposed wire springs are constructed as wire-form springs devoid of coils and cylindrical structures. The pair of opposed wire springs may exhibit mirror symmetry with respect to one another.

In some embodiments, the pair of opposed wire springs each include a non-metallic resistance band thereon engaged with the flapper member. In some embodiments, the lateral openings are defied on an outer circumferential surface of the flapper member extending into opposed blind holes, and the free ends of the wire springs may be restrained in the lateral openings each abut a bottom surface of a respective one of the opposed blind holes. In some embodiments, the lateral openings are defined on an elongated channel extending through a central rib of the flapper member.

In one or more embodiments, the spring support comprises a pair of lateral arms connected by a circumferential cross-beam, and the each of the pair of opposed wire springs is supported in a hole provided in a respective one of the lateral arms of the spring support. Free ends of the wire springs opposite the free ends restrained in the lateral openings of the flapper member may be axially and laterally spaced from the holes in the spring support when the wire springs are in a relaxed configuration. In some embodiments, the assembly further includes a linear spring and a hinge coupled between the wire springs and the spring support.

In another aspect, the disclosure is directed to a wellbore system. The wellbore system includes a tubular string disposed at a downhole location in a wellbore, a tubular body coupled within the tubular string the tubular body defining a longitudinal axis and a flow path therethrough, a flapper member pivotally coupled to tubular body about a pivot axis and movable between a closed position where the flapper member prevents fluid flow through the flow path and an open position where fluid flow through the flow path is permitted, the flapper member including a pair of opposed lateral openings defined therein radially spaced from the pivot axis, a spring support coupled to the tubular body and extending axially along the longitudinal axis, and a pair of opposed wire springs each individually coupled between the spring support and the flapper member, the wire springs each including a free end restrained in a respective one of the lateral openings defied in the flapper member.

In some embodiments, the pair of opposed wire springs exhibit mirror symmetry with respect to one another and are constructed as wire-form springs devoid of coils and cylindrical structures. The lateral openings may be defined on an outer circumferential surface of the flapper member extending into opposed blind holes and wherein the free ends abut a bottom surface of a respective one of the opposed blind holes. In some embodiments, the lateral openings are defined on an elongated channel extending through a central rib of the flapper member.

In one or more embodiments, the spring support comprises a pair of lateral arms connected by a circumferential cross-beam, and wherein the each of the pair of opposed wire springs is supported in a hole provided in a respective one of the lateral arms of the spring support. Free ends of the wire springs opposite the free ends restrained in the lateral openings of the flapper member may be axially and laterally spaced from the holes in the spring support when the wire springs are in a relaxed configuration. In some embodiments, the system further includes a linear spring and a hinge coupled between the wire springs and the spring support.

In another aspect, the disclosure is directed to a method of constructing a downhole valve assembly. The method includes pivotally coupling a flapper member to a tubular body such that the flapper member is movable between a closed position where the flapper member prevents fluid flow through a flow path defined by the tubular body and an open position where fluid flow through the flow path is permitted, securing a spring support to the tubular body, the spring support extending axially from the tubular member and circumferentially around the flow path, restraining free ends of a pair of opposed wire springs in into a respective one of a pair of opposed lateral openings defined in the flapper member and preloading each of the wire springs between the spring support and the flapper member such that the wire springs cooperate to bias the flapper member toward the closed position.

In one or more aspects, the method further includes constructing the wire springs as wire-form springs devoid of coils and cylindrical structures such that the wire springs exhibit mirror symmetry with respect to one another. In some embodiments, preloading each of the wire springs comprises installing free ends of the wire springs opposite the free ends restrained in the lateral openings of the flapper member into holes defined in the spring support.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A downhole valve assembly, comprising:

a tubular body defining a longitudinal axis and a flow path therethrough;

a flapper member pivotally coupled to the tubular body about a pivot axis and movable between a closed position where the flapper member prevents fluid flow through the flow path and an open position where fluid flow through the flow path is permitted, the flapper member including a pair of opposed lateral openings defined on an outer circumferential surface of the flapper member and radially spaced from the pivot axis;

a spring support coupled to the tubular body and extending axially along the longitudinal axis; and a pair of opposed wire springs each individually coupled between the spring support and the flapper member, the wire springs each including a free end restrained in a respective one of the lateral openings defined in the flapper member, a respective wire segment extending laterally beyond the flapper member from the respective lateral opening and a respective lateral spring arm extending longitudinally from the respective wire segment such that the flapper member is pivotable between the lateral spring arms.

2. The assembly of claim 1, wherein the pair of opposed wire springs are constructed as wire-form springs devoid of coils and cylindrical structures.

3. The assembly of claim 2, wherein the pair of opposed wire springs exhibit mirror symmetry with respect to one another.

4. The assembly of claim 1, wherein the pair of opposed wire springs each include a non-metallic resistance band thereon engaged with the flapper member.

5. The assembly of claim 1, wherein the lateral openings extend into opposed blind holes.

6. The assembly of claim 5, wherein the free ends of the wire springs restrained in the lateral openings each abut a bottom surface of a respective one of the opposed blind holes.

7. The assembly of claim 1, wherein the lateral openings are defined on an elongated channel extending through a central rib of the flapper member.

8. The assembly of claim 1, wherein the spring support comprises a pair of lateral support arms connected by a circumferential cross-beam, and wherein the each of the pair of opposed wire springs is supported in a hole provided in a respective one of the lateral support arms of the spring support.

9. The assembly of claim 8, wherein free ends of the wire springs opposite the free ends restrained in the lateral openings of the flapper member are axially and laterally spaced from the holes in the spring support when the wire springs are in a relaxed configuration.

10. The assembly of claim 1, further comprising a linear spring and a hinge coupled between the wire springs and the spring support.

11. A wellbore system, comprising:

a tubular string disposed at a downhole location in a wellbore;

a tubular body coupled within the tubular string, the tubular body defining a longitudinal axis and a flow path therethrough;

a valve seat within the tubular body, the flow path defined longitudinally through a fixed opening in the valve seat;

a flapper member pivotally coupled to the tubular body about a pivot axis and movable between a closed position where the flapper member engages the valve seat and prevents fluid flow through the flow path and an open position where the flapper member does not intrude into the flow path and fluid flow through the flow path is permitted, the flapper member including a pair of opposed lateral openings defined therein radially spaced from the pivot axis;

a spring support coupled to the tubular body and extending axially along the longitudinal axis; and a pair of opposed wire springs each individually coupled between the spring support and the flapper member, the wire springs each including a free end restrained in a respective one of the lateral openings defined in the flapper member, a respective wire segment extending laterally beyond the flapper member from the respective lateral opening and a respective lateral spring arm extending longitudinally from the respective wire segment such that the flapper member is pivotable between the lateral spring arms.

12. The system of claim 11, wherein the pair of opposed wire springs exhibit mirror symmetry with respect to one another and are constructed as wire-form springs devoid of coils and cylindrical structures.

13. The system of claim 11, wherein the lateral openings are defined on an outer circumferential surface of the flapper member extending into opposed blind holes and wherein the free ends abut a bottom surface of a respective one of the opposed blind holes.

14. The system of claim 11, wherein the lateral openings are defined on an elongated channel extending through a central rib of the flapper member.

15. The system of claim 11, wherein the spring support comprises a pair of lateral support arms connected by a circumferential cross-beam, and wherein the each of the pair of opposed wire springs is supported in a hole provided in a respective one of the lateral support arms of the spring support.

16. The system of claim 15, wherein free ends of the wire springs opposite the free ends restrained in the lateral openings of the flapper member are axially and laterally spaced from the holes in the spring support when the wire springs are in a relaxed configuration.

17. The system of claim 11, further comprising a linear spring and a hinge coupled between the wire springs and the spring support.

18. A method of constructing a downhole valve assembly, the method comprising:

pivotally coupling a flapper member to a tubular body such that the flapper member is movable between a closed position where the flapper member prevents fluid flow through a flow path defined by the tubular body and an open position where fluid flow through the flow path is permitted;

securing a spring support to the tubular body, the spring support extending axially from the tubular member and circumferentially around the flow path;

restraining free ends of a pair of opposed wire springs in a respective one of a pair of opposed lateral openings defined in the flapper member such that a respective lateral spring arms extend longitudinally from the flapper member laterally beyond the flapper member and such that the flapper member is pivotable between the lateral spring arms to an open position wherein the flapper member does not intrude into the flow path; and preloading each of the wire springs between the spring support and the flapper member such that the wire springs cooperate to bias the flapper member toward the closed position.

19. The method of claim 18, further comprising constructing the wire springs as wire-form springs devoid of coils and cylindrical structures such that the wire springs exhibit mirror symmetry with respect to one another.

20. The method of claim 18, wherein preloading each of the wire springs comprises installing free ends of the wire springs opposite the free ends restrained in the lateral openings of the flapper member into holes defined in the spring support.

* * * * *